United States Patent [19]

Walker

[11] 4,411,363

[45] Oct. 25, 1983

[54] HOLDER FOR SKEINS OF EMBROIDERY FLOSS

[76] Inventor: Lois J. Walker, 6708 Blue Spruce Ct., Union Lake, Mich. 48085

[21] Appl. No.: 410,425

[22] Filed: Aug. 23, 1982

Related U.S. Application Data

[63] Continuation of Ser. No. 159,058, Jun. 13, 1980, abandoned.

[51] Int. Cl.[3] ..... B65D 85/00

[52] U.S. Cl. ..... 206/388

[58] Field of Search ..... 206/388, 63.3, 417, 206/392; 223/107

[56] References Cited

U.S. PATENT DOCUMENTS 3,949,452 4/1976 Hendersen ..... 206/388

4,172,521 10/1979 Eubanks et al. ..... 206/388

FOREIGN PATENT DOCUMENTS 13053 8/1903 Austria ..... 206/388

21160 of 1894 United Kingdom ..... 206/388

*Primary Examiner*—Joseph Man-Fu Moy

*Attorney, Agent, or Firm*—Basile, Weintraub & Hanlon

[57] ABSTRACT

A holder for ends of skeins of embroidery floss is disclosed. The holder is defined by a substantially planar member (10) having a plurality of apertures (12) formed therein. A plurality of tabs (14) are formed or associated with the planar member. The color-coded end of a skein of embroidery floss is projected through an aperture and mounted onto an associated tab. The planar member has a plurality of dimensional demarcations (16) formed along one linear edge thereof.

5 Claims, 2 Drawing Figures

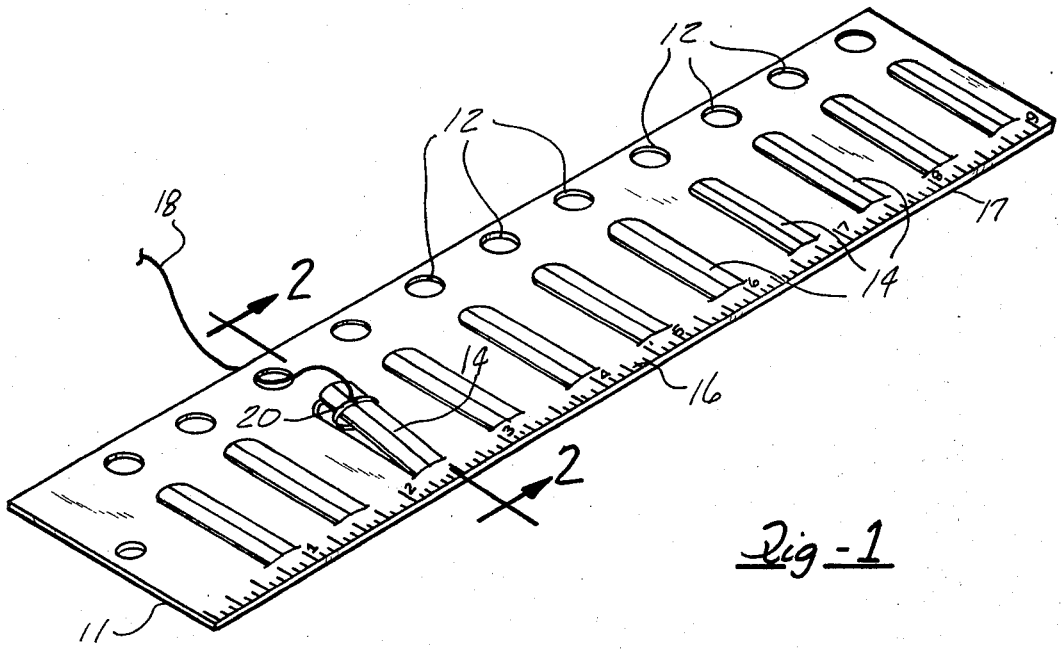
Fig-1
Fig-2
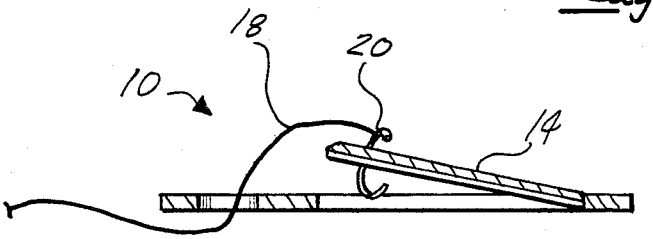

HOLDER FOR SKEINS OF EMBROIDERY FLOSS

This application is a continuation of application Ser. No. 159,058, filed June 13, 1980, now abandoned.

BACKGROUND OF THE INVENTION

I. Field of the Invention

The present invention concerns embroidery. More particularly, the present invention concerns skeins of embroidery floss. Even more particularly, the present invention concerns and relates to holders for skeins of embroidery floss.

II. Prior Art

In embroidering patterns on whatever medium so desired it is not the atypical situation to employ plural skeins of embroidery floss. Often times the color of one skein of floss is very closely related in shade to another skein thereby creating confusion, absent some orderly form of aligning the skeins. Furthermore, quite often some skeins are being employed while others are dormant awaiting use. The unused skeins can become entangled, knotted up or otherwise disfunctional.

Also, as is known to those skilled in the art to which the present invention pertains, each skein of floss has its terminal end color-coded. Conventionally, a color-coded ring is bound to the skein of floss at the terminal end. The color associated with the ring is a standardized color thereby rendering it easy for reorder and color differentiation. Sometimes, however, the ring can become lost, destroyed or otherwise ineffective. This makes it quite difficult to reorder a skein of embroidery floss the exact same color. All of these encumbrances arise because there is no general scheme for holding and retaining skeins of embroidery floss in an orderly manner. As will be subsequently be detailed the present invention seeks to overcome this situation.

SUMMARY OF THE INVENTION

In accordance with the present invention there is provided a holder for skeins of embroidery floss which comprises a generally planar member having a plurality of apertures formed therein. Each aperture is dimensioned to receive therethrough and to have project therethrough a color-coded end of a skein of embroidery floss. The present invention further includes a plurality of tabs which are formed out of the planar member. Each tab is associated with a single aperture. The tab is formed proximate the associated aperture and removably mounts thereon the color-coded ring of a skein of floss. The tab, which, as noted, is formed in the planar member is rotatable in order to permit the mounting of the ring thereonto.

The planar member has at least one linear edge. A plurality of dimensional demarcations are disposed along the linear edge for effecting measurement of the skein of embroidery floss.

For a more complete understanding of the present invention reference is made to the following detailed description and accompanying drawing. In the drawing like reference characters refer to like parts throughout the several views in which:

BRIEF DESCRIPTION OF THE DRAWING

FIG. 1 is a perspective view of an embroidery floss holder in accordance with the present invention.

FIG. 2 is a cross sectional view taken along the line 2—2 of FIG. 1 and which shows a tab used in the practice of the present invention.

DESCRIPTION OF THE PREFERRED EMBODIMENT

Now, and with reference to the drawing, there is shown therein a holder for a skein of embroidery floss in accordance with the present invention and generally indicated at 10. The holder hereof preferably comprises a planar member 11. The planar member can have any desired geometric configuration. The rectangular configuration shown in the drawing is optimal, but is not to be considered as limitative of the present invention.

The planar member is formed from any suitable material such as a rigid plastic, fibrous materials such as cardboard or any other type of material which can achieve the functions desired herein.

At least one aperture 12 is formed in the planar member. The aperture 12 is dimensioned to receive and have projected therethrough a color-coded end of a skein of embroidery floss, as will be discussed hereinafter. Preferably, the holder 10 hereof has a plurality of apertures formed therein. The apertures are preferably aligned and formed along the length of the holder. Generally, the apertures are disposed medially of the holder.

Each aperture defines a means for receiving a color-coded end of a skein of floss.

Associated with each one aperture is a tab or mounting member 14. The tab or mounting member 14 defines means for removably retaining a color-coded end of the skein of floss on the holder. The tab is formed from or punched out of the holder by any suitable method such as die or the like. The tab is limitedly rotatable about the longitudinal axis of the holder. The limited rotational movement permits the color-coded end of the skein of floss to be retained on the tab. Because of the limited rotation, in effect, the tab cooperates with the base of the planar member to pinch the color-coded end between the tab and the planar member. As noted, there is a single tab associated with a single aperture. The tab is formed proximate the aperture. Preferably, the tab has a slight arc or radius. The arc or radius facilitates the grasping thereof for mounting the color-coded end of a skein of floss thereonto.

The planar member 11 preferably comprises at least one linear edge 17. A plurality of dimensional demarcations 16 are marked along the linear edge and substantially perpendicular thereto. The dimensional demarcation can be in any international unit such as inches or fractions thereof or meters or fractions thereof.

In employing the holder hereof a skein of floss 18 has an associated color-coded ring 20 formed at one end thereof. The color-coded end and the associated ring is projected through or received through an associated aperture 12. Then, the ring 20 is mounted onto a tab 14. Because of the limited rotatability of the tab the ring is, in effect, pinched between the planar member and the tab, as shown.

It is to be appreciated that the holder hereof maintains an orderly array of a plurality of skeins of embroidery floss and minimizes the risk of losing the color-coded ring. Likewise, the tabs themselves could be color-coded to an international convention and employed for mounting an associated colored skein of floss thereon.

The holders hereof, as here and above noted, are formed from any suitable material. Nominally, the holders are formed from any rigid plastic material and the tabs are die cut thereinto.

It is to be appreciated that there has been described herein a holder for a skein of embroidery floss which permits maintaining of order amongst plural skeins of floss.

Having, thus, described the invention what is claimed is:

1. A holder for a skein of embroidery floss comprising:

(a) a planar member, (b) an aperture formed in the planar member for receiving a color-coded end of a skein of a floss, the color-coded end being projectable through the aperture; and (c) means for removably retaining the color-coded end of a skein of floss after being projected through the aperture, the retaining means being formed in the planar member and juxtaposed the aperture, the retaining means including:

a planar tab formed in the planar member, the tab having a base end integrally formed with the planar member and a free end limitedly rotatable about the longitudinal axis of the planar member for receiving the color-coded end of the skein of floss thereon such that the planar tab removably pinching pinches the color-coded end of skein of floss between itself and the planar member when disposed in the plane of the planar member.

2. The holder of claim 1 which further comprises:

at least one linear edge formed along the planar member, and a plurality of dimensional demarcations disposed along the linear edge.

3. The holder of claim 1 wherein;

the planar member has a plurality of apertures formed therein.

4. The holder of claim 3 which further comprises:

a plurality of tabs formed on the planar member, each one tab being associated with an aperture.

5. The holder of claim 4 wherein:

the apertures lie along a common axis.

* * * * *